US007991538B2

(12) United States Patent
Olbrich et al.

(10) Patent No.: US 7,991,538 B2
(45) Date of Patent: Aug. 2, 2011

(54) METHOD FOR OPERATING A FUEL SYSTEM

(75) Inventors: Stephan Olbrich, Stuttgart (DE); Rainer Peck, Ludwigsburg (DE); Christian Kriechbaum, Stuttgart (DE); Michael Schenk, Ludwigsburg (DE); Steffen Meyer-Salfeld, Leonberg (DE); Rene Zieher, Edingen-Neckarhausen (DE); Markus Viereck, Emmendingen (DE)

(73) Assignee: Robert Bosch GmbH, Stuttgart (DE)

( * ) Notice: Subject to any disclaimer, the term of this patent is extended or adjusted under 35 U.S.C. 154(b) by 405 days.

(21) Appl. No.: 12/340,114

(22) Filed: Dec. 19, 2008

(65) Prior Publication Data

US 2009/0164102 A1 Jun. 25, 2009

(30) Foreign Application Priority Data

Dec. 19, 2007 (DE) ..... 10 2007 061 230
Nov. 25, 2008 (DE) ..... 10 2008 044 050

(51) Int. Cl.
*G06F 19/00* (2006.01)
*F02M 51/00* (2006.01)

(52) U.S. Cl. ..... 701/104; 701/115; 123/458; 123/480

(58) Field of Classification Search ..... 123/445, 123/447, 456–460, 478, 480, 494, 495; 701/101–105, 110, 114, 115; 73/114.38, 73/114.43

See application file for complete search history.

(56) References Cited

U.S. PATENT DOCUMENTS 4,614,174 A * 9/1986 Tanigawa et al. ..... 123/478
6,311,674 B1 * 11/2001 Igashira et al. ..... 123/458
6,557,530 B1 * 5/2003 Benson et al. ..... 123/480
7,000,600 B1 * 2/2006 Yamada et al. ..... 123/494

* cited by examiner

*Primary Examiner* — Willis R Wolfe, Jr.
(74) *Attorney, Agent, or Firm* — Kenyon & Kenyon LLP

(57) ABSTRACT

In a fuel system of an internal combustion engine, the fuel quantity injected into a combustion chamber is a function of an activation period, during which a fuel injection device is activated. A pressure sensor detects the pressure in the fuel rail and provides a signal. The pressure in the fuel rail may be regulated to a setpoint pressure using a setting unit and employing the signal provided by the pressure sensor. The following method is provided for testing the fuel system:

(a) establishing a test fuel quantity to be injected;
(b) operating the internal combustion engine using a first setpoint pressure and a first activation period corresponding thereto and to the test fuel quantity to be injected;
(c) detecting a speed- or torque-dependent variable characterizing the operating state;
(d) operating the internal combustion engine using a second setpoint pressure and a second activation period corresponding thereto and to the test fuel quantity to be injected;
(e) detecting a speed- or torque-dependent variable characterizing the operating state;
(f) implementing an action if the variables detected in (c) and (e) differ by more than a limit value.

11 Claims, 3 Drawing Sheets

METHOD FOR OPERATING A FUEL SYSTEM

BACKGROUND INFORMATION

Common rail fuel systems in which the fuel is delivered into a fuel rail by a pumping unit are known from the market. Multiple fuel injection devices are connected thereto, which inject the fuel directly into combustion chambers assigned thereto. The pressure in the fuel rail is detected by a pressure sensor and regulated to a variable setpoint pressure by a setting unit. The fuel quantity injected into a combustion chamber is a function on the one hand of the instantaneous actual pressure in the fuel rail and on the other hand, of the activation period and the injection period of the fuel injection devices related thereto.

The signal provided by the pressure sensor may be flawed due to damage, intentional manipulation, or pronounced drift, which has the result that the real pressure prevailing in the fuel rail deviates from the setpoint pressure more than desired. The durability of components of the fuel system may thus be reduced, the mixture formation quality may decrease, and deviations of the actual injection quantity from a setpoint injection quantity may result. The latter plays an important role in the field of engine tuning, in particular.

SUMMARY OF THE INVENTION

An object of the present invention is to detect, in a simple way, a malfunction of the pressure sensor which detects the prevailing pressure in the fuel rail.

This object is achieved by a method according to the present invention.

The present invention makes use of the nonlinear characteristic of the so-called "activation period characteristics map" of the fuel injection device. This nonlinearity allows an offset of the pressure ascertained on the basis of the signal of the pressure sensor in relation to the real pressure prevailing in the fuel rail to be detected. Such an offset occurs, for example, in the event of a manipulation of the pressure sensor within the scope of an engine tuning measure to generate a higher fuel pressure in the fuel rail—and thus increase the injected fuel quantity—and thus finally the torque.

In the method according to the present invention, an attempt is made to inject the same fuel quantities at different pressures in the fuel rail. At a higher pressure, a shorter activation period is required for a same fuel quantity and vice versa. If the pressure sensor is operating incorrectly or is intentionally manipulated, the real prevailing pressure in the fuel rail deviates from the pressure ascertained from the signal of the pressure sensor. Because of the nonlinear characteristic of the activation characteristic map, the deviation of the fuel quantity during the first activation period is different than during the second activation period. In turn, this indicates that the torque resulting at the first setpoint pressure deviates from that which results at the second setpoint pressure. In contrast, if the pressure sensor was operating correctly, both torques would be approximately equal. In the method according to the present invention, the cited torque difference is at least indirectly detected and, if the difference exceeds a limit value, an action is initiated on its basis, for example an incorrectly operating or manipulated pressure sensor inferred.

The method according to the present invention allows the diagnosis of the pressure sensor, which detects the pressure in the fuel rail without additional components being necessary. The durability of the components of the fuel system may be improved by the present invention and the reliability of good mixture formation is increased, which finally results in a reduction of the fuel consumption and improved emissions, and manipulations of the pressure sensor may be reliably detected and the liability problems associated with such manipulations may thus be eliminated.

A first advantageous development of the present invention provides that steps (b) and (d) are each executed starting from an initial-operation operating state preferably using the first setpoint pressure. This improves the accuracy of the method according to the present invention.

In a refinement thereto, it is provided that the variable detected in steps (c) and (e) is a time that elapses from the beginning of the operation using the first and second activation periods in steps (b) and (d), respectively, until a specific operating state is reached. This prevents an undesired operating state being caused by the method according to the present invention, such as an operating state which lies outside the normal operating limits of the internal combustion engine. Thus, damage to the internal combustion engine is ultimately prevented in this way.

The specific operating state may be defined by a predefined number of crankshaft rotations from the beginning of the operation using the first and second activation periods in steps (b) and (d), respectively. The number of the crankshaft rotations is easily detectable by the crankshaft sensor, which is provided in any case. The time that passes for a predefined number of crankshaft rotations is an extremely sensitive variable that characterizes the torque and therefore ensures a particularly reliable detection of an error or a manipulation of the pressure sensor.

However, it is also fundamentally conceivable that the specific operating state is defined by a predefined final speed of a crankshaft of the internal combustion engine from the beginning of the operation using the first and second activation periods in steps (b) and (d), respectively. Of course, it is advantageous in this context if the starting speed is the same in each case. In addition, it is to be ensured that the final speed does not lie above the maximum permissible speed.

It is particularly advantageous if the initial-operation operating state is an idling operation, because a relatively low pressure typically prevails in the fuel rail during idling and a brief activation period of the fuel injection device is provided, which increases the significance in carrying out the method according to the present invention.

The action that is carried out in step (f) may include an entry in an error memory, for example, but also an emergency shutoff of the internal combustion engine, if the method according to the present invention is not performed within the scope of a repair shop examination, but rather in normal operation.

DETAILED DESCRIPTION

Figure 1:
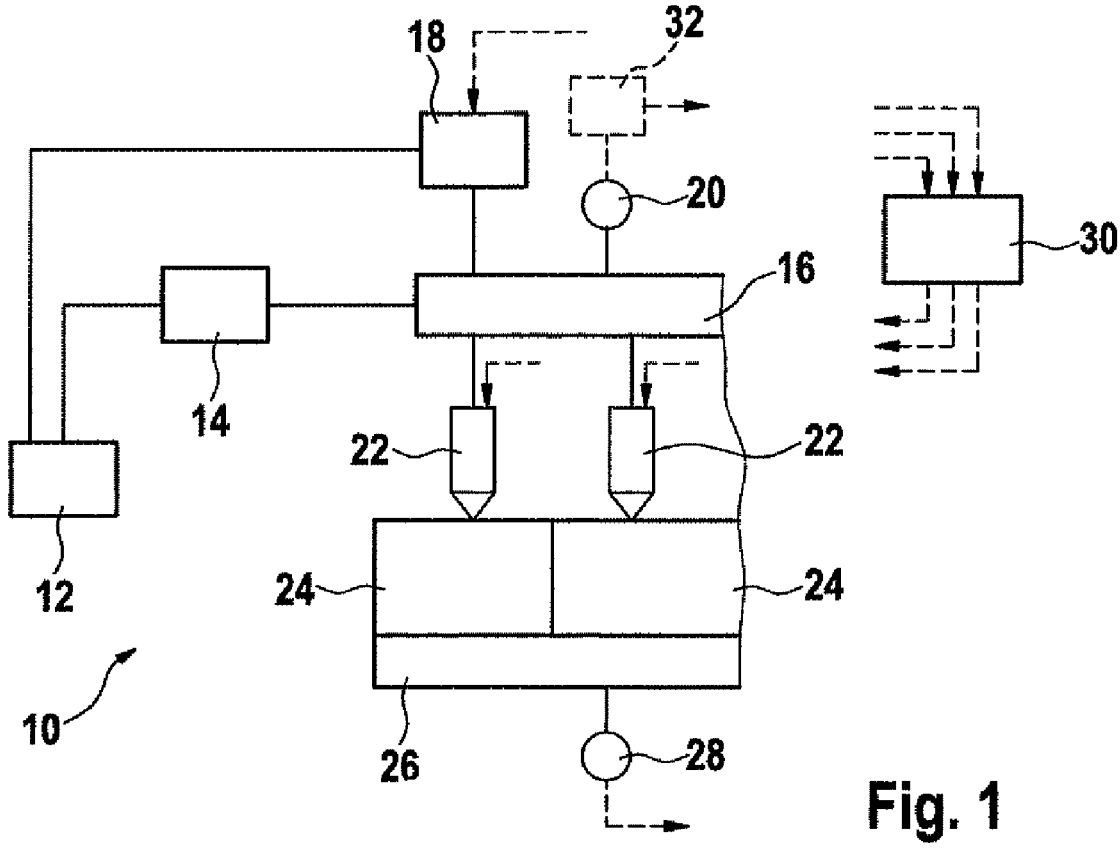
FIG. 1 shows a schematic illustration of a common rail fuel system of an internal combustion engine.

A fuel system bears reference numeral 10 as a whole in FIG. 1. It includes a fuel container 12, from which a pumping unit 14, for example, including a predelivery pump and a high-pressure pump, delivers the fuel into a fuel rail 16. A pressure regulating valve 18 and a pressure sensor 20 are connected thereto.

Furthermore, multiple injectors 22 are connected to fuel rail 16, which inject the fuel directly into combustion chambers 24 of an internal combustion engine (not shown further) assigned thereto. Upon the combustion of the injected fuel in combustion chambers 24, a crankshaft 26 is set into rotation. A crankshaft sensor 28 detects the rotations and the speed of crankshaft 26.

The operation of the internal combustion engine and also of fuel system 10 is controlled and/or regulated by a control and regulating device 30. For this purpose, control and regulating device 30 receives, inter alia, a signal from pressure sensor 20 and from crankshaft sensor 28. Inter alia, injectors 22 and pressure regulating valve 18 are activated by control and regulating device 30.

The fuel quantity to be injected is established in normal operation of the internal combustion engine in consideration of various parameters, such as a desired torque. To inject the desired fuel quantity into a combustion chamber 24, corresponding injector 22 is opened for a specific time period. This time period is in turn a function of the period of an activation signal ("activation period").

The fuel quantity discharged into a combustion chamber 24 by an injector 22 is not only a function of the activation period, however, but also of the pressure prevailing in fuel rail 16. For the same activation period, more fuel is injected at a higher pressure in fuel rail 16 than at a lower pressure. The pressure in fuel rail 16 is variable in normal operation of the internal combustion engine and is set as a function of various operating variables, such as a setpoint injection quantity, an operating temperature, and/or a speed of the internal combustion engine.

Figure 2:
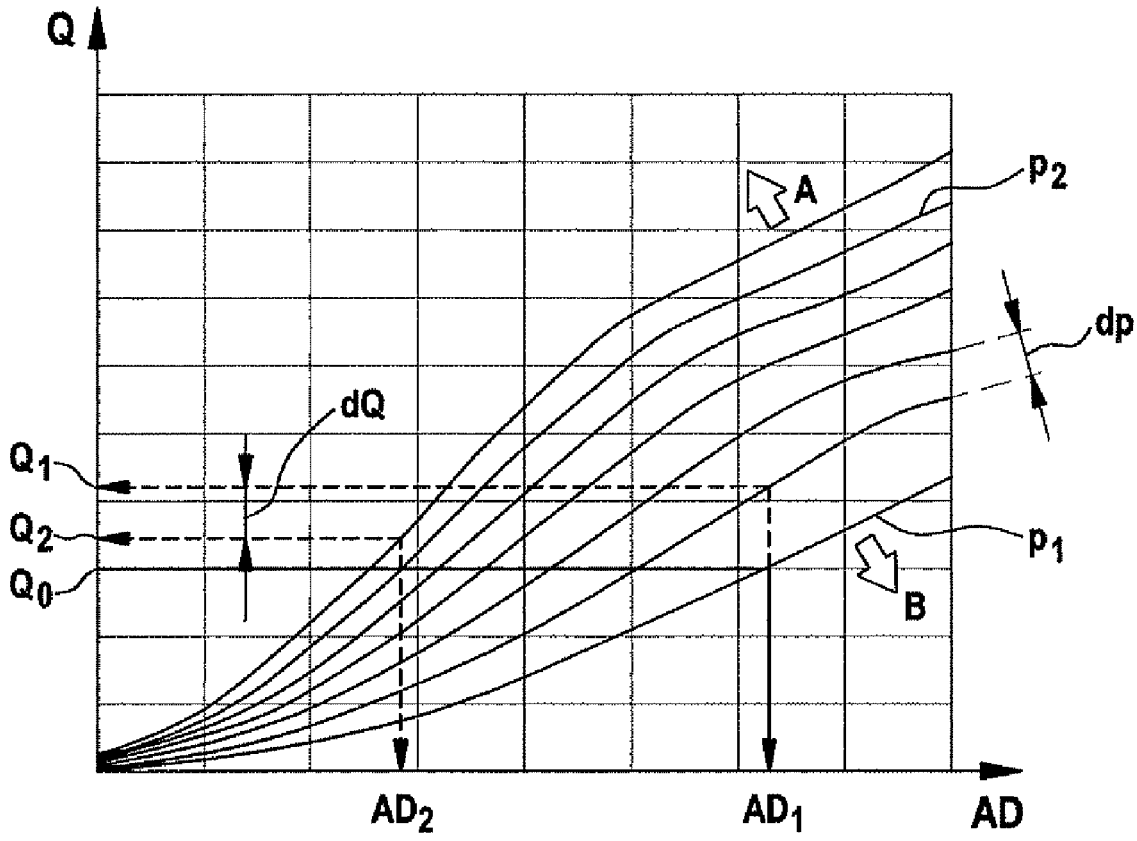
FIG. 2 shows a diagram in which an activation period of a fuel injection device of the fuel system of FIG. 1 and an injected fuel quantity at different pressures in a fuel rail of the fuel system of FIG. 1 are plotted.

Therefore, to inject a specific fuel quantity into combustion chamber 24, appropriate activation period AD for a specific fuel quantity Q and a specific pressure $p_2$ prevailing in fuel rail 16 are ascertained using a so-called "activation period characteristic map", as is shown as an example in FIG. 2. The curves plotted in the diagram in FIG. 2 are isobars, an arrow A pointing in the direction of a higher pressure and an arrow B pointing in the direction of a lower pressure. A pressure differential dp between the particular isobars is constant; it may be 200 bar, for example.

So-called "engine tuning" is sometimes performed to enhance the performance of internal combustion engines. A simple type of such engine tuning includes switching a tuning device 32 (only indicated by dashed lines in FIG. 1) between pressure sensor 20 and control and regulating device 30, which alters the signal delivered by pressure sensor 20 to control and regulating device 30 in such a way that the indicated "actual pressure" is lower than the real pressure. A control circuit provided in control and regulating device 30, which regulates the indicated actual pressure to a setpoint value, will therefore generate a pressure in fuel rail 16 that is higher by an offset.

Due to the increased fuel pressure, during an injection a greater fuel quantity is injected by an injector 22 into combustion chamber 24 than without tuning device 32, which results in a torque increase. However, the wear of the components of fuel system 10 and the internal combustion engine increases concurrently, the mixture formation quality sinks, etc. The detection of such manipulations is therefore important. A method, using which it is possible to detect such a manipulation or damage or drift of pressure sensor 20, is explained in greater detail with reference to FIG. 3. The described method may be performed during an inspection of the internal combustion engine, for example.

After a start in 34, the internal combustion engine is first brought into an initial operating state, namely an idling state, in 36. A constant idling speed is set relatively exactly therein by a typical idling regulator, at a first, comparatively low setpoint pressure $p_1$ (compare FIG. 2). A test fuel quantity $Q_0$ is established in 38, which is greater in any case than the fuel quantity to be injected normally in idling. In 40, a corresponding first activation period $AD_1$ is ascertained from the activation characteristics map of FIG. 2 for test fuel quantity $Q_0$ and first setpoint pressure $p_1$.

In 42, a first test operating state is started, in which injectors 22 are activated at first setpoint pressure $p_1$ using first activation period $AD_1$ corresponding to test fuel quantity $Q_0$ to be injected. At the beginning of the operation using activation period $AD_1$, a counter is started, which counts the number of the rotations of crankshaft 26 on the basis of the signal from crankshaft sensor 28. A timer is started simultaneously, which detects the time that passes from the beginning of the operation using first activation period $AD_1$.

In 44, the number of the rotations of crankshaft 26 from the beginning of the operation using first activation period $AD_1$ is compared to a limit value. This limit value represents a specific target operating state. As soon as the limit value is reached, the time that has passed until then from the beginning of the operation using first activation period $AD_1$ is detected in 46 and stored. This time is thus a speed-dependent variable which characterizes the target operating state. In 48, the internal combustion engine is brought back into the initial operating state, i.e., idling.

In 50, the pressure in fuel rail 16 is increased by control and regulating device 30 by appropriately activating pressure regulating valve 18 to a pressure $p_2$ (compare FIG. 2). Pressure regulating valve 18 thus acts as a setting unit for regulating the pressure in fuel rail 16 to a setpoint pressure. It is to be noted here that in embodiments which are not shown, instead of a pressure regulating valve or in addition thereto, a metering unit (suction throttle) may be used upstream from the high-pressure pump or another pump-side quantity control unit as a setting unit.

In 52, similarly to above step 40, an activation period $AD_2$, corresponding to test fuel quantity $Q_0$ and pressure $p_2$, is ascertained using the activation characteristics map of FIG. 2. A second test operation is started in 54, in which injectors 22 are activated using activation period $AD_2$. Detecting the number of rotations of crankshaft 26 and the time that has passed from the beginning of the activation of injectors 22 using activation period $AD_2$ is simultaneously begun again. In 56, the accumulated number of rotations of crankshaft 26 is again compared to a limit value, this limit value being identical to that in step 44. If the limit value has been reached, the accumulated time is detected in 58 and stored. In 60, the difference between the times detected and stored in 46 and 58 is calculated, and in 62 the amount of this difference is compared to a limit value. If the difference is greater than the limit value, an entry in an error memory is made in 64. The method ends in 66.

Figure 3:
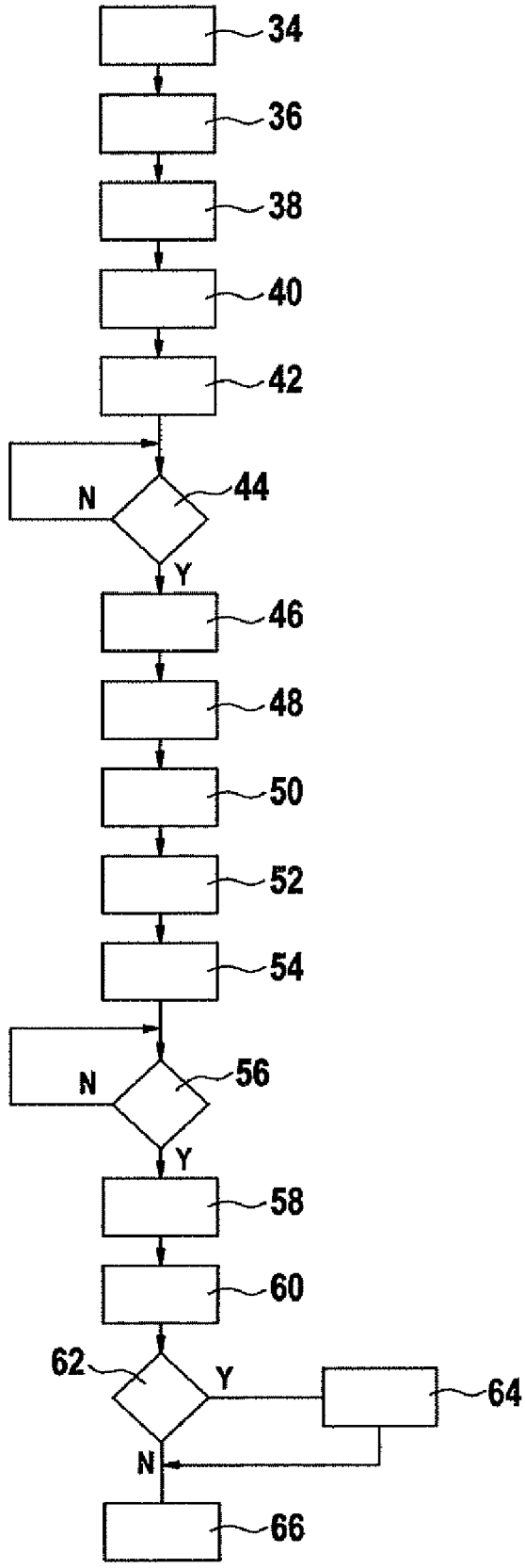
FIG. 3 shows a flow chart of a method for testing the fuel system of FIG. 1.

The method of FIG. 3 is based on the following considerations: If pressure sensor 20 is operating correctly, without tuning device 32, the indicated actual pressure would be identical to the real pressure. The fuel quantity that would have been actually injected at activation period $AD_1$ and pressure $p_1$ would thus be equal to the fuel quantity that would have been injected at activation period $AD_2$ and pressure $p_2$, namely test fuel quantity $Q_0$ to be injected. Because of installed tuning device 32, however, the real pressure in fuel rail 16 is greater than the actual pressure indicated by control and regulating device 30 by a differential dp. Therefore, a real injected fuel quantity $Q_1$ results for activation period $AD_1$, and a real injected fuel quantity $Q_2$ results for activation period $AD_2$ from the activation period characteristics map of FIG. 2.

Because of the nonlinearity of the activation period characteristics map, fuel quantity $Q_1$ is greater than fuel quantity $Q_2$. In the first test operation (steps 42 and 44 of FIG. 3), more fuel therefore reaches the corresponding combustion chamber 24 during an injection than in the second test operation (steps 54 and 56 in FIG. 2). The torque generated during each combustion is therefore greater in the first test operation than in the second test operation, which results in a stronger rotational acceleration of crankshaft 26. This in turn has the result that the limit value in step 44 is reached in the first test operation after a shorter time than in the second test operation (step 56). This time difference is analyzed in 62 and the installation of tuning device 32 assumed therefrom is indicated in 64.

In the embodiment described above, the method was used for detecting tuning device 32. However, the method may also be used very generally for detecting an error of pressure sensor 20. It may also be analyzed whether the difference calculated in 60 is greater or less than zero, i.e., whether the indicated actual pressure is less or greater than the real pressure. This allows further qualification in regard to a drift of pressure sensor 20, for example. In particular, the method is suitable for the onboard diagnosis OBD. Such a diagnosis monitors exhaust-relevant functions and/or components, in particular.

In an especially advantageous development of the procedure of the present invention it is provided that a variable which characterizes the injected fuel quantity is evaluated. Normally, a signal or a variable that characterizes the actually injected fuel quantity is available in control devices 30. Such a signal that characterizes the injected fuel quantity is determined, for instance, on the basis of an engine speed signal, a Lambda signal, and/or a fuel pressure signal. In this specific development, it is checked whether a changed rail pressure causes a changed fuel quantity, by evaluating a variable that characterizes the injected fuel quantity. If this is the case, i.e., if the injection quantity changes at a changed rail pressure, then an error is detected.

If such a signal that characterizes the injected fuel quantity is present, then the afore-described procedure is modified in such a way that not the number of rotations of the crankshaft is evaluated but instead the internally available signal that characterizes the fuel quantity is used. Unnecessary steps are omitted. In step 60, the two fuel quantities are then compared.

Following a start in 34, the internal combustion engine is first brought into an initial operating state in 36. In this operating state, at a first and relatively low setpoint pressure $p_1$ (compare FIG. 2), a test fuel quantity $Q_0$ is specified in 38. In 40, a corresponding first activation period $AD_1$ is determined from the activation characteristics map of FIG. 2 for fuel quantity $Q_0$ and first setpoint pressure $p_1$.

In 42, a first test operating state is started, in which injectors 22 are activated at first setpoint pressure $p_1$ using first activation period $AD_1$ corresponding to test fuel quantity $Q_0$ to be injected.

In 46, actually injected fuel quantity Qist1 is determined based on a variable available in the control device.

In 50, control and regulating device 30 increases the pressure in fuel rail 16 to a pressure $p_2$ by appropriate activation of pressure regulating valve 18 (compare FIG. 2).

In 52, similarly to above step 40, an activation period $AD_{27}$ corresponding to test fuel quantity $Q_0$ and pressure $p_2$, is ascertained using the activation characteristics map of FIG. 2. In 54, a second test operation is started, in which injectors 22 are activated using activation period $AD_2$.

In 58, actually injected fuel quantity Qist2 is determined based on a variable available in the control device.

In 60, the difference between the fuel quantities Qist1 and Qist3 detected in 46 and 58 is formed, and in 62, the amount of this difference is compared to a limit value. If the difference is greater than the limit value, an entry in an error memory is made in 64. The method ends in 66.

This procedure has the advantage that is it implementable not only in idling operation after the start, but in all operating points. Furthermore, there is the advantage that no retrospective effects result on the driving behavior, and the check takes place without the driver being aware of it.

What is claimed is:

1. A computer-readable medium containing a computer program which when executed by a processor performs a method for operating a fuel system of an internal combustion engine, in which a fuel quantity injected into a combustion chamber of an internal combustion engine is a function of an activation period using which a fuel injection device is activated, in which a pressure sensor detects a pressure in a fuel rail and provides a signal, and in which the pressure in the fuel rail is regulated to a setpoint pressure using a setting unit and employing the signal provided by the pressure sensor, the method comprising:

(a) establishing a test fuel quantity to be injected;

(b) operating the internal combustion engine using a first setpoint pressure and a first activation period corresponding thereto and to the test fuel quantity to be injected;

(c) detecting a first value of a variable characterizing an operating state;

(d) operating the internal combustion engine using a second setpoint pressure and a second activation period corresponding thereto and to the test fuel quantity to be injected;

(e) detecting a second value of the variable characterizing the operating state; and (f) implementing an action if the detected first and second values of the variable differ by more than a limit value.

2. A control/regulating device for operating a fuel system of an internal combustion engine, in which a fuel quantity injected into a combustion chamber of an internal combustion engine is a function of an activation period using which a fuel injection device is activated, in which a pressure sensor detects a pressure in a fuel rail and provides a signal, and in which the pressure in the fuel rail is regulated to a setpoint pressure using a setting unit and employing the signal provided by the pressure sensor, the device comprising at least one arrangement for performing the following:

(a) establishing a test fuel quantity to be injected;

(b) operating the internal combustion engine using a first setpoint pressure and a first activation period corresponding thereto and to the test fuel quantity to be injected;

(c) detecting a first value of a variable characterizing an operating state;

(d) operating the internal combustion engine using a second setpoint pressure and a second activation period corresponding thereto and to the test fuel quantity to be injected;

(e) detecting a second value of the variable characterizing the operating state; and (f) implementing an action if the detected first and second values of the variable differ by more than a limit value.

3. The device according to claim 2, wherein the fuel system is of a motor vehicle.

4. A method for operating a fuel system of an internal combustion engine, in which a fuel quantity injected into a combustion chamber of an internal combustion engine is a function of an activation period using which a fuel injection device is activated, in which a pressure sensor detects a pressure in a fuel rail and provides a signal, and in which the pressure in the fuel rail is regulated to a setpoint pressure using a setting unit and employing the signal provided by the pressure sensor, the method comprising:

(a) establishing a test fuel quantity to be injected;

(b) operating the internal combustion engine using a first setpoint pressure and a first activation period corresponding thereto and to the test fuel quantity to be injected;

(c) detecting a first value of a variable characterizing an operating state;

(d) operating the internal combustion engine using a second setpoint pressure and a second activation period corresponding thereto and to the test fuel quantity to be injected;

(e) detecting a second value of the variable characterizing the operating state; and (f) implementing an action if the detected first and second values of the variable differ by more than a limit value.

5. The method according to claim 4, wherein the variable characterizing the operating state characterizes at least one of an engine speed, a torque and an actually injected fuel quantity.

6. The method according to claim 4, wherein the action includes an entry in an error memory.

7. The method according to claim 4, wherein the steps (b) and (d) are each executed starting from an initial operating state using the first setpoint pressure.

8. The method according to claim 7, wherein the variable detected is a time that elapses from a beginning of an operation using the first and second activation periods, respectively, until reaching a specific operating state.

9. The method according to claim 8, wherein the specific operating state is defined by a predefined number of crankshaft rotations from the beginning of the operation using the first and second activation periods, respectively.

10. The method according to claim 8, wherein the specific operating state is defined by a predefined final speed of a crankshaft of the internal combustion engine from the beginning of the operation using the first and second activation periods, respectively.

11. The method according to claim 8, wherein an initial operating state is an idling.

* * * * *